US006622403B2

(12) United States Patent
Munie

(10) Patent No.: US 6,622,403 B2
(45) Date of Patent: Sep. 23, 2003

(54) BACKFILL AND GRADING APPARATUS

(76) Inventor: Michael J. Munie, P.O. Box 24006, Belleville, IL (US) 62226

( * ) Notice: Subject to any disclaimer, the term of this patent is extended or adjusted under 35 U.S.C. 154(b) by 0 days.

(21) Appl. No.: 09/824,446

(22) Filed: Apr. 2, 2001

(65) Prior Publication Data

US 2002/0044830 A1 Apr. 18, 2002

Related U.S. Application Data

(60) Provisional application No. 60/194,500, filed on Apr. 3, 2000.

(51) Int. Cl.[7] ..... E02F 5/12
(52) U.S. Cl. ..... 37/142.5; 405/179
(58) Field of Search ..... 37/142.5; 172/4, 172/4.5, 7; 405/179; 222/612, 613, 56, 181.2; 404/84.1, 75, 110, 105

(56) References Cited

U.S. PATENT DOCUMENTS 2,772,919 A * 12/1956 Jones ..... 294/68.21
3,672,724 A * 6/1972 Neuzil ..... 298/1 C
4,782,606 A * 11/1988 Surface ..... 37/142.5
4,871,025 A * 10/1989 Mayfield et al. ..... 172/4.5
5,452,969 A * 9/1995 Crook ..... 405/303
6,158,925 A * 12/2000 Schleining et al. ..... 371/142.5
6,386,792 B1 * 5/2002 Stevenson ..... 172/833

* cited by examiner

*Primary Examiner*—Thomas B. Will
*Assistant Examiner*—Meredith Petravick
(74) *Attorney, Agent, or Firm*—Polster, Lieder, Woodruff & Lucchesi

(57) ABSTRACT

Apparatus for depositing material within a trench including a hopper and an elongated chute extending down from the hopper which is configured to fit within the trench. The apparatus includes a gate between the hopper and the chute for controlling flow of material out of the hopper through the chute. The apparatus preferably is mounted with a variably positionable mount on the back of a tractor and can include a laser guided control system to maintain the deposit of material at a predetermined grade.

16 Claims, 2 Drawing Sheets

BACKFILL AND GRADING APPARATUS

CROSS REFERENCE TO RELATED APPLICATIONS

This application claims the benefit of U.S. provisional patent application Ser. No. 60/194,500, filed Apr. 3, 2000.

BACKGROUND OF THE INVENTION

The invention relates generally to construction, excavation and turf equipment and, more specifically, to a novel apparatus for the even application of backfill material at an excavated site at a consistent, predetermined grade or level.

It is understood by those in the construction and excavation trades that various types of excavated sites require backfilling. For example, if an operator excavates or digs a trench and lays underground pipe, the pipe then is covered with the dirt or other material and the trench then is filled in or backfilled. The trench can be filled with various materials, such as the dirt that was removed to form the trench or sand, gravel, rock or any desired material. In most cases, the backfill material is crudely pushed back into the trench with the excavating equipment and then finished by hand. Alternatively, the backfill material is shoveled back into the trench by hand, which is quite labor intensive.

In some applications, pipe, for example, which is placed in a trench must be placed on a bedding of specified material, such as gravel and then covered with the gravel before the trench is backfilled with dirt. Such applications include the installation of subterranean drain pipes in athletic fields, golf courses and the like. The bedding of gravel as well as the gravel covering the pipe must be placed evenly in the trench as a predetermined grade. Because the trenches often are narrow, a laborer is required to shovel the gravel into the trench and then rake the gravel into the specified grade. As will be appreciated by those skilled in the art, this procedure is extremely time consuming and costly.

It would be advantageous, therefore, to have automated equipment that can install the bedding material, such as gravel, within a trench at a predetermined grade, thus reducing the time and cost of the application.

SUMMARY OF THE INVENTION

It is an object of the present invention to provide an apparatus for depositing material in a trench at a predetermined grade.

It is another object of the present invention to provide such an apparatus that can be mounted on the back of a vehicle, such as a tractor or a trailer, for use.

It is another object of the present invention to provide such an apparatus for use in a form that is itself towable or movable along a trench, such as providing the apparatus in trailer form.

Another object of the invention is to provide such an apparatus that can deposit the material at a predetermined grade guided by a laser.

Still another object of the invention is to provide such an apparatus that is safe and easy to use, economical to construct, and well suited for its intended purposes.

In summary, the novel apparatus for depositing material within a trench includes a hopper to store a quantity of the material and an elongated chute extending down from the hopper which is configured to fit appropriately within a trench. The apparatus includes a gate between the hopper and the chute for controlling flow of material out of the hopper through the chute. The gate can be manually or automatically controlled. The apparatus preferably is mounted on the back of vehicle such as a tractor or a trailer and includes a laser guided control system which automatically controls the depth of deposit of material at a predetermined level or grade.

More specifically, the present invention includes apparatus for depositing material in a trench, the apparatus comprising a hopper, an elongated chute coupled to the hopper and extending downwardly therefrom, and a gate between the hopper and the elongated chute, wherein the apparatus is coupled to a an adjustable mounting means configured d for coupling to a vehicle, the adjustable mounting means further configured to variably position the apparatus along a substantially vertical axis with respect to the vehicle. The adjustable mounting means is, for example, a hydraulic mount.

In another aspect, the present invention is directed toward apparatus for backfilling a trench at a predetermined grade, the apparatus comprising a hopper, an elongated chute coupled to the hopper and extending downwardly therefrom, and a gate between the hopper and the elongated chute, wherein the apparatus is coupled to a vehicle having a hydraulic positioning system further configured to variably position the apparatus along a substantially vertical axis with respect to the vehicle as the vehicle advances along the trench so that a lower edge of the chute is maintained at the predetermined grade level.

In still another aspect, the present invention is directed toward a method for maintaining a predetermined grade level of material while backfilling a trench with the material, the method comprising providing apparatus comprising a hopper for receiving the material, the hopper coupled to an elongated chute having a lower edge, and a gate between the hopper and chute for controlling the flow of material from the hopper into the chute, coupling the apparatus to a vehicle using a variably positionable mounting means configured so that the relative position of the apparatus is adjustable along a substantially vertical axis with respect to the vehicle, lowering the apparatus until the lower edge of the chute is positioned at the predetermined grade level, and filling the trench with material to the predetermined grade level by advancing the apparatus along the trench while maintaining the lower edge of the chute at the predetermined grade level, thereby controlling the flow of material through the chute.

In use, the operator digs a trench and the pipe is installed in the trench at the predetermined grade. The pipe then is covered with the appropriate material, such as gravel by using the novel device as follows. A laser emission device, or laser sender, is positioned at the site at a predetermined grade and a laser signal emitted by the laser sender is received by a conventional laser receiving device which is mounted on the apparatus and tractor and operatively connected to hydraulics on the tractor to raise or lower the apparatus in response to the laser signal. The hopper is filled with gravel. The operator lowers the chute into the trench and above the pipe to the predetermined grade. The operator then moves the tractor forward along the path of the trench and opens the apparatus gate so that the gravel is deposited on the pipe at the predetermined grade. The depth of the grade is adjusted in response to the laser signal as the tractor proceeds along the length of the trench thereby depositing the gravel on the pipe at the predetermined grade along the length of the trench. If a bedding of gravel is required on the floor of the trench before the pipe is laid, it is applied to the floor of the trench using the just recited procedure.

DESCRIPTION OF THE INVENTION

Figure 1:
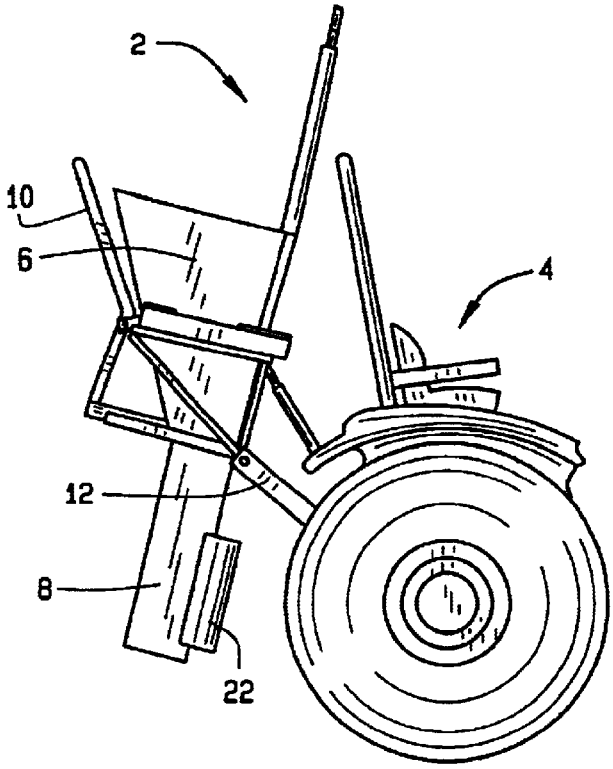
FIG. 1 is a side elevational view of the backfill apparatus of the present invention.
Figure 2:
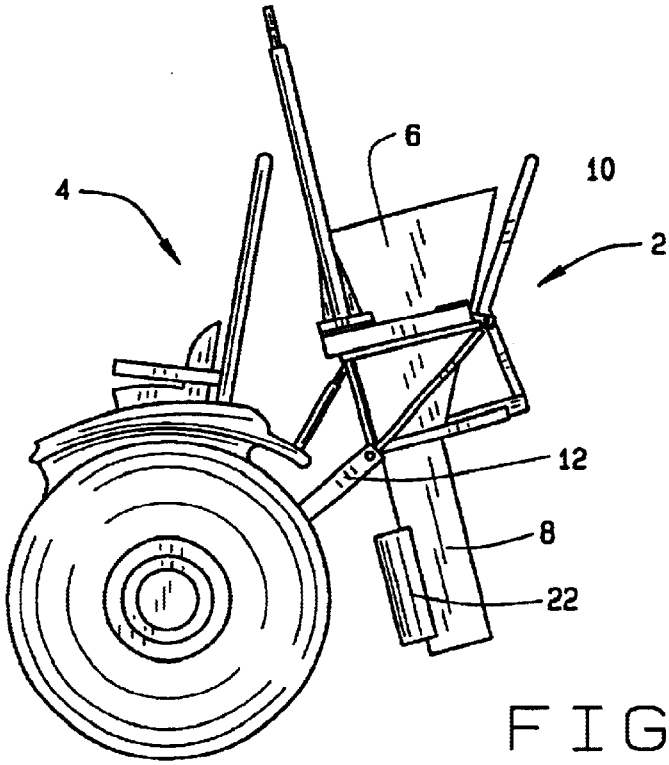
FIG. 2 is a side elevational view of the backfill apparatus of the present invention showing the side opposite illustrated in FIG. 1.
Figure 3:
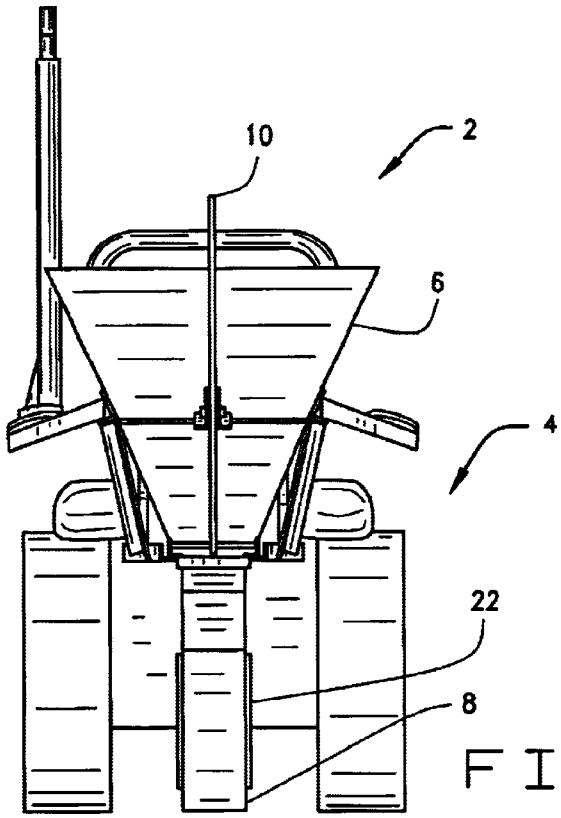
FIG. 3 is a rear plan view thereof.

Refrerring to FIGS. 1–3, the apparatus 2 of the present invention is shown in detail mounted to the rear end of a small tractor 4. In an alternative embodiment, apparatus 2 is mounted on the end of another mobile vehicle suitable for use at a construction site, such as a trailer or cart. The apparatus 2 includes a hopper 6 coupled to an elongated chute 8. Chute 8 extends generally downwards from the hopper 6, and is configured to fit appropriately within a construction trench. As will be noted, there is a handle 10 on the apparatus 2 for manually controlling the position of a gate (not shown) that extends between the hopper 6 and chute 8, to thereby control flow of material from the hopper 6 down into and through the chute 8. Alternatively, the gate can be automatically controlled.

Apparatus 2 is coupled to the tractor 2 with a variably positionable mounting means for variably positioning apparatus 2 up and down along a substantially vertical axis with respect to the tractor 4. The mounting means can be, for example, an adjustable mount using slidable or pivoting couplings allowing for smooth up and down adjustment of the apparatus position. In an exemplary embodiment, apparatus 2 is coupled to tractor 4 by a hydraulic mount 12 that variably positions apparatus 2 up and down along a substantially vertical axis with respect to the tractor 4. Hydraulic mount 12 includes a control element (not shown) that controls the vertical position of apparatus 2 in response to input signals. Thus, the position of apparatus 2 is can be made subject to automatic control through the operation of the control element in conjunction with, or as part of, an automatic control system. Alternatively, hydraulic mount 12 can be manually manipulated to control the position of apparatus 2. It will be understood that the chute 8 has a lower edge, and the position of the chute lower edge with respect to material within the trench varies in accordance with the relative position of apparatus 2 with respect to the tractor 4, as well as with the relative position of the tractor 4 with respect to the trench as the tractor 4 advances over the surrounding terrain.

It should also be understood that alternative embodiments of the present invention contemplate a relatively larger hopper 6 than the hopper 6 as shown in FIGS. 1–5. For example, in alternative embodiments the apparatus 2 itself takes the form of a vehicle or towable trailer wherein the size of the hopper 6 is limited only by practical size limitations on the trailer, and weight limitations imposed by the fill material loaded within the hopper 6. For example, hopper 6 can be substantially a hopper on wheels, with chute 8 extending therefrom. Such an embodiment thereby allows for substantially increased volume and weight of material that can be loaded into the hopper 6. In still another alternative embodiment, for example, hopper 6 can be mounted on a trailer also bearing a conveyor belt or other bulk transfer device that transfers fill material in bulk to hopper 6 from a supply of fill material also on the trailer. In such alternative embodiments, the entire vehicle or trailer is mounted on hydraulics so that the hydraulics can variably position the apparatus 2, and thus chute 8, along a substantially vertical axis with respect to the vehicle as the vehicle advances along the trench, so that a lower edge of said chute is maintained at the predetermined grade level as described more completely below.

In an exemplary embodiment, an automatic control system in accordance with the present invention includes a conventional laser beam receiver (not shown) operatively connected to the control element of the hydraulic mount 12. The laser beam receiver is configured to generate a feedback control signal that depends on the whether the receiver is receiving a laser signal, as described below. The control element is configured to raise or lower the apparatus 2 in response to the feedback control signal from the receiver when the laser signal is received by the receiver. A conventional laser emission device, or sender (not shown), is appropriately positioned at the construction site so that a visible laser beam emitted by the sender indicates a predetermined level or grade at the construction site. The receiver is appropriately positioned with respect to the sender so that the receiver on the hydraulic mount 12 intercepts the laser beam emitted by the sender.

Figure 4:
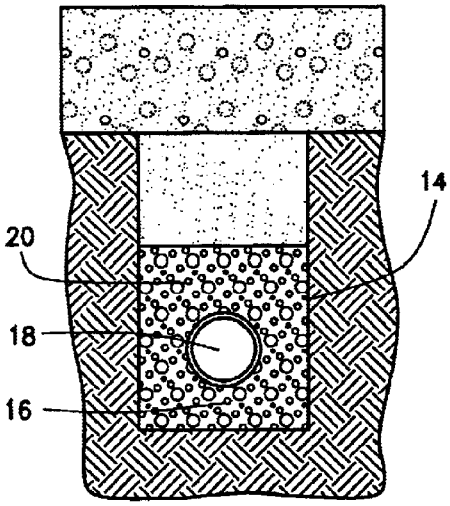
FIG. 4 is an end plan view of a trench containing drainage pipe showing a typical application for the backfill apparatus of the present invention.
Figure 5:
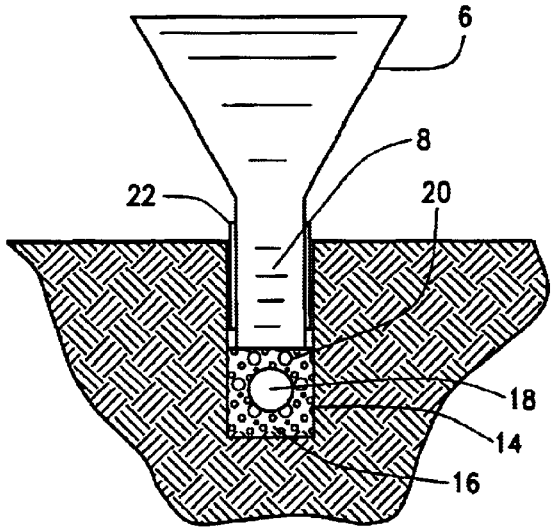
FIG. 5 is a front plan view of the apparatus in use in a trench.

In use, the laser sender and receiver in operation with the control element automatically control the depth of deposit of material at the predetermined level or grade at the construction site. More specifically, an operator digs a trench 14, and bedding 16 is installed in the trench 14. Pipe 18 is installed in the trench 14, as shown in FIGS. 4–5. The pipe 18 then is placed on bedding 16 and covered to the predetermined grade, with appropriate material 20 such as, for example, gravel, using apparatus 2 as follows. The laser sender, positioned appropriately at the construction site so that the laser beam emitted by the sender indicates the predetermined grade, is aimed toward the laser receiver mounted on the apparatus 2 so that the receiver receives the laser signal from the sender when the apparatus 2 is appropriately positioned to deposit the gravel at the predetermined grade or level. It will be appreciated that the relative positions of the sender and receiver with respect to one another, as well as the path of the laser beam, may describe a number of different geometric configurations which can all be suitable for monitoring the grade of the material as it is deposited in the trench 14. Thus, the exact location of the receiver on the hydraulic mount 12, the location of the laser sender at the construction site, and the chosen path of the laser beam are limited only by the necessity that the receiver be in a position to intercept the laser beam from the sender as the tractor advances along the trench 14 while depositing the gravel or other material.

The hopper 6 is filled with gravel. The operator lowers the chute 8 into the trench 14 until the lower edge of the chute 8 reaches the depth that is the predetermined grade. The sender is then energized, the laser beam emitted by the sender indicates the predetermined grade, and the laser beam is received by the receiver on the hydraulic mount 12. The operator then moves the tractor 4 forward along the path of the trench 14 and opens the apparatus gate so that the gravel is deposited on the pipe 16 at the predetermined grade. The flow of gravel from the hopper 6 into the chute 8, and thus the speed at which gravel is deposited, is controlled by the speed at which apparatus 2 is advanced along the trench. The flow of gravel can be stopped by manually or automatically controlling the relative position of the gate between the hopper 6 and the chute 8. As the tractor 4 advances along the trench 14 depositing gravel, the receiver on the hydraulic mount 12 is receiving the laser beam from the sender. The receiver and control element are configured to form a feedback control loop such that if and when the laser beam strays off the receiver as the tractor 4 advances, the control element signals the hydraulic mount 12 to appropriately adjust the position of the apparatus 2, and thus also the position of the lower edge of chute 8, by raising or lowering apparatus 2, thereby maintaining the predetermined grade or level.

More specifically, the receiver and control element can be configured so that, for example, if the laser beam strays off the receiver at a first or top end of the receiver, the control element sends a control signal to the hydraulic mount to raise apparatus 2, and if the laser beam strays off the receiver at a second or bottom end of the receiver, the control element sends a control signal to the hydraulic mount to lower apparatus 2. Thus, the depth of the grade of gravel or other material is adjusted as the lower edge of chute 8 is raised or lowered in response to the laser signal as the tractor 4 proceeds along the length of the trench 14, thereby depositing the gravel on the pipe 16 at the predetermined grade along the length of the trench 14. If a bedding of gravel at a predetermined grade is required on the floor of the trench 14 before the pipe 16 is laid, it is applied to the floor of the trench 14 using the just recited procedure. In less grade-sensitive applications, the up and down positioning of apparatus 2, and thus the grade, can be controlled manually by the operator by conventional manipulation of the tractor's hydraulically controlled mount 12.

Referring again to the drawings, FIG. 4 illustrates a typical construction application for the use of the novel apparatus 2 in the installation of a subdrainage lateral on an athletic field. As can be seen, the contractor digs a trench about 8 inches wide. The subgrade is compacted and a bedding or layer of gravel 16 is placed. The drainage pipe 18, which in this illustration is a 3 inch perforated lateral, is installed on the gravel drainage material 16 and then covered with the drainage gravel 20. The drainage gravel 20 is placed in the trench 14 at a specified level or grade. The apparatus 2 of the present invention is used to place the drainage gravel 20 at the specified grade or elevation.

As shown in FIG. 5, the chute 8 of the apparatus 2 is introduced into the trench 14 to the desired level or grade above the drain lateral 18. The operator then drives the tractor 4 forward with the gate open between the hopper 6 and chute 8 so that the gravel moves from the hopper 6 through the chute 8 to be deposited evenly on top of the pipe 18. The apparatus 2, in response to the laser guided control as described above, will be moved up or down, as required to maintain the specified grade of gravel in the trench 14. As will be noted in FIGS. 1–2 and 5, the chute 8 of the apparatus includes a bumper 22 to prevent the chute 8 from digging into and disrupting the trench 14 as the tractor 4 moves forward.

As stated above, in those applications where maintenance of the grade of gravel is not as critical, the apparatus 2 can be used without the laser guided control and simply moved up and down by conventional hydraulics or a manual mechanism.

Although the use of the apparatus 2 was described using drainage gravel on a drainage lateral under an athletic field, it will be appreciated that the apparatus of the present invention can be used on any type construction site and with any fill material, such as gravel, sand, dirt, shredded rubber, or the like, without departing from the scope of the invention. The apparatus also can be used to backfill shallower or deeper trenches. Or, the chute can be removed and the device used to deposit material on a surface.

It will be appreciated by those skilled in the art that various changes and modifications can be made in the illustrated backfill apparatus without departing from the scope of the invention. Therefore, the foregoing description and accompanying figures are intended to be illustrative only and should not be construed in a limiting sense.

What is claimed is:

1. An apparatus for depositing material in a trench formed in a surface, said apparatus comprising:

a hopper having a reservoir area for holding material and an elongated chute having a proximal end and a distal end extending downwardly from the reservoir area, the elongated chute being configured to fit within a trench having a cross sectional shape of one of either a quadrilateral, a semicircle, a curve, or a V-shape, the elongated chute having a lower edge at the distal end, wherein the elongated chute is positioned and sized such that only the elongated chute fits into the trench;

a gate between said reservoir area and said proximal end of the elongated chute; and an adjusted mounting means configured for coupling said apparatus to a vehicle, said adjustable mounting means further configured to variably position said apparatus along a substantially vertical axis with respect to the vehicle so that said lower edge of the elongated chute is variably positioned at a predetermined grade level below the surface into which said trench is formed.

2. Apparatus in accordance with claim 1 wherein said adjustable mounting means is a hydraulic mount.

3. Apparatus in accordance with claim 1 wherein said adjustable mounting means is configured for manual repositioning of said apparatus with respect to the vehicle.

4. Apparatus in accordance with claim 1 wherein said adjustable mounting means comprises a control element configured to automatically reposition said apparatus with respect to the vehicle in response to a feedback control signal.

5. Apparatus in accordance with claim 4 further comprising a laser receiver on said adjustable mounting means, configured to send the feedback control signal to said control element in response to a laser signal.

6. Apparatus in accordance with claim 5 further comprising a laser sender positioned at the trench, said laser sender configured to emit a laser beam that generates the laser signal for the receiver.

7. Apparatus for backfilling a trench at a predetermined grade, said apparatus comprising:

a hopper, the hopper comprising a reservoir area for holding material and an elongated chute having a first end and a second end comprising a lower edge and extending downwardly from the reservoir area, the elongated chute being dimensioned to fit within a trench having a cross-sectional shape of one of either a quadrilateral, a semicircle, a curve, or a V-shape, wherein the elongated chute is positioned and sized such that only the elongated chute fits into the trench;

a gate between said reservoir area and said elongated chute located at the first end of the elongated chute; and a hydraulic positioning system configured to variably position said apparatus along a substantially vertical axis with respect to the vehicle as the vehicle advances along the trench so that said lower edge elongated chute is maintained at the predetermined grade level below the surface into which the trench is formed.

8. Apparatus in accordance with claim 7 wherein said hydraulic positioning system is configured for manual repositioning of said apparatus with respect to the vehicle.

9. Apparatus in accordance with claim 7 wherein said hydraulic positioning system comprises a control element configured to automatically reposition said apparatus with respect to the vehicle in response to a feedback control signal.

10. Apparatus in accordance with claim 9 further comprising a laser receiver on said hydraulic positioning system, configured to send the feedback control signal to said control element in response to a laser signal.

11. Apparatus in accordance with claim 10 further comprising a laser sender positioned at the trench, said laser sender configured to emit a laser beam that generates the laser signal for the receiver.

12. A method for maintaining a predetermined grade level of material in a trench while backfilling the trench with the material, said method comprising:

providing apparatus comprising a hopper, the hopper comprising a reservoir area and an elongated chute having a gate at a first end and a lower edge at a opposite end, the gate being between the reservoir area and the elongated chute and being used for controlling the flow of material from the hopper into the chute;

coupling apparatus to a vehicle using a variably positionable mounting means configured so that the relative position of the apparatus is adjustable along a substantially vertical axis with respect to the vehicle;

lowering the apparatus until the lower edge of the elongated chute is positioned in a trench, the trench having a cross sectional shape selected from a group of cross-sectional shaped consisting of a quadrilateral, a semicircle, a curve, or a V-shape, wherein the elongated chute is located and sized such that only the elongated chute fits into the trench; and filling the trench with material to the predetermined grade level by advancing the apparatus along the trench while maintaining the lower edge of the elongated chute at the predetermined grade level in the trench, thereby controlling the flow of material through the elongated chute.

13. A method in accordance with claim 12 further comprising, as the vehicle advances, readjusting the relative position of the apparatus with respect to the vehicle so that the position of the lower edge of the chute is maintained at the predetermined grade level.

14. A method in accordance with claim 13 wherein readjusting the relative position of the apparatus with respect to the vehicle comprises manually readjusting the variably positionable mounting means.

15. A method in accordance with claim 13 wherein readjusting the relative position of the apparatus with respect to the vehicle comprises automatically readjusting the variably positionable mounting means using an automatic control system.

16. A method in accordance with claim 15 wherein automatically readjusting the variably positionable mounting means using an automatic control system comprises providing a laser guided control system for controlling the adjustment of the variably positionable mounting means.

* * * * *

UNITED STATES PATENT AND TRADEMARK OFFICE

CERTIFICATE OF CORRECTION

PATENT NO. : 6,622,403 B2
DATED : September 23, 2003
INVENTOR(S) : Michael J. Munie It is certified that error appears in the above-identified patent and that said Letters Patent is hereby corrected as shown below:

Column 2,
Line 12, between “to” and “an” delete “a”
Line 12, between “configured” and “for” delete “d”

Column 6,
Line 21, replace “adjusted” with -- adjustable --
Line 46, replace “Apparatus” with -- apparatus --; and before “Apparatus” insert -- An --; and between “trench” and “a” replace “at” with -- to --
Line 62, between “edge” and “elongated” insert -- of said --

Column 7,
Line 23, between “coupling” and “apparatus” insert -- the --
Line 30, replace “shaped” with -- shapes --

Signed and Sealed this

Ninth Day of March, 2004

JON W. DUDAS
*Acting Director of the United States Patent and Trademark Office*